US006109711A

United States Patent [19]

Hoffman

[11] Patent Number: 6,109,711

[45] Date of Patent: Aug. 29, 2000

[54] CONTAINER WITH A DOOR WHICH CAN BE OPENED 270 DEGREES

[75] Inventor: Andreas Hoffman, Neuerburg, Germany

[73] Assignee: Electrolux S.A.R.L., Luxembourg, Sweden

[21] Appl. No.: 09/447,076

[22] Filed: Nov. 22, 1999

[30] Foreign Application Priority Data

Dec. 18, 1998 [SE] Sweden ..... 9804404

[51] Int. Cl.[7] ..... A47B 49/00

[52] U.S. Cl. ..... 312/326; 16/366

[58] Field of Search ..... 312/257.1, 258, 312/262, 263, 326, 329, 222, 249.8, 109; 16/366, 368, 369, 86.1; 49/381, 397, 399, 246, 248

[56] References Cited

U.S. PATENT DOCUMENTS 5,042,198 8/1991 Privratsky ..... 49/248
5,211,502 5/1993 Upham-Hill ..... 403/353
5,975,660 11/1999 Tisbo et al. ..... 312/263

FOREIGN PATENT DOCUMENTS 556 679 A1 8/1993 European Pat. Off. .
801197 10/1997 European Pat. Off. .
2699587 6/1994 France .

*Primary Examiner*—Peter M. Cuomo
*Assistant Examiner*—James O. Hansen
*Attorney, Agent, or Firm*—Pearne & Gordon LLP

[57] ABSTRACT

A container (10) with a rectangular access opening (12) is closable by a rectangular door (14), which is turnably journalled on the container by a rod (22) having downwardly directed pins (26) journalled in the container (10) and upwardly directed pins (28) journalled in the door (14), so that the door (14) can be opened about 270° relative to the container (10).

1 Claim, 3 Drawing Sheets

CONTAINER WITH A DOOR WHICH CAN BE OPENED 270 DEGREES

FIELD OF THE INVENTION

The invention refers to a container with a rectangular access opening closable by a rectangular door, each of the container and the door having an axis, which are in parallel with and located at a distance from each other and are connected to each other by link means journalled around the axes, so that the door can be opened about 270° relative to the container.

BACKGROUND OF THE INVENTION

Such containers are known through EP 801 197 and FR 2 699 587. At these containers the link means are constituted by two rods, which are threaded through holes in a plurality of links and are journalled around each of the axes.

SUMMARY OF THE INVENTION

The object of the invention is to improve the known containers, so that the number of details included in the link means can be substantially reduced and that the link means will be easy to mount.

This object is reached through the container according to the invention thereby that the link means are constituted by a rod having at least three downwardly directed pins journalled in the container around one of the axes and at least three upwardly directed pins journalled in the door around the other axis, which pins are fastened in pairs to oblong plates, one downwardly directed pin being fastened at one end of the respective plate and one upwardly directed pin being fastened at the other end of the plate and the plates being fastened to the rod between the pins at right angles to the rod.

BRIEF DESCRIPTION OF THE DRAWINGS

An embodiment of a container according to the invention is described below in connection with the enclosed drawings, in which.

DETAILED DESCRIPTION OF THE PREFERRED EMBODIMENTS

Figure 1:
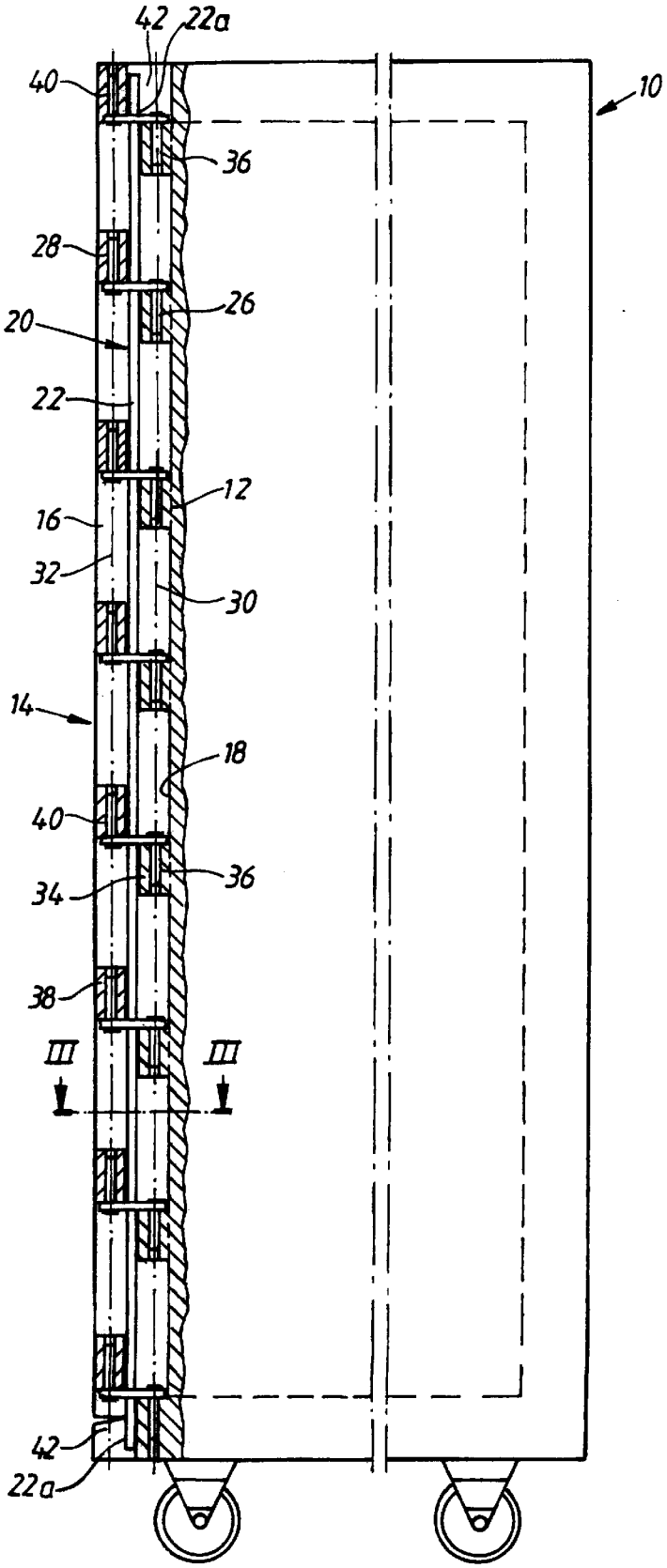
FIG. 1 shows, partly in a sectional view, one side of the container with a closed door, which is journalled on the container by a link means.
Figure 2:
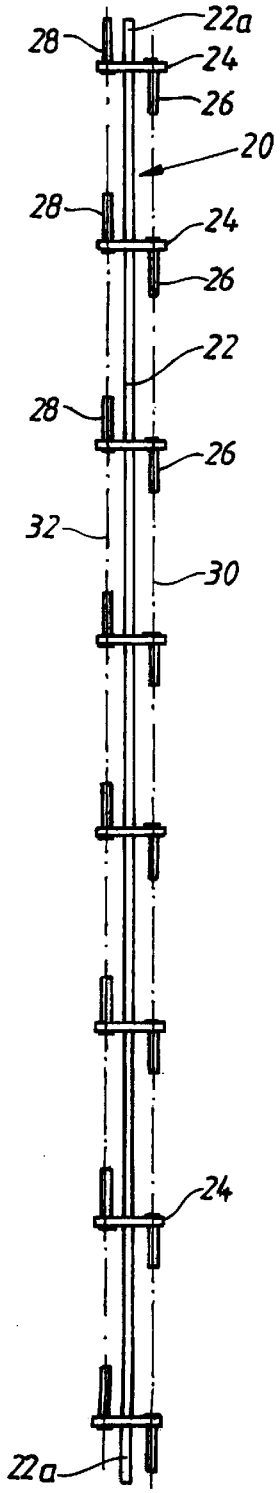
FIG. 2 shows the very link means.
Figure 6:
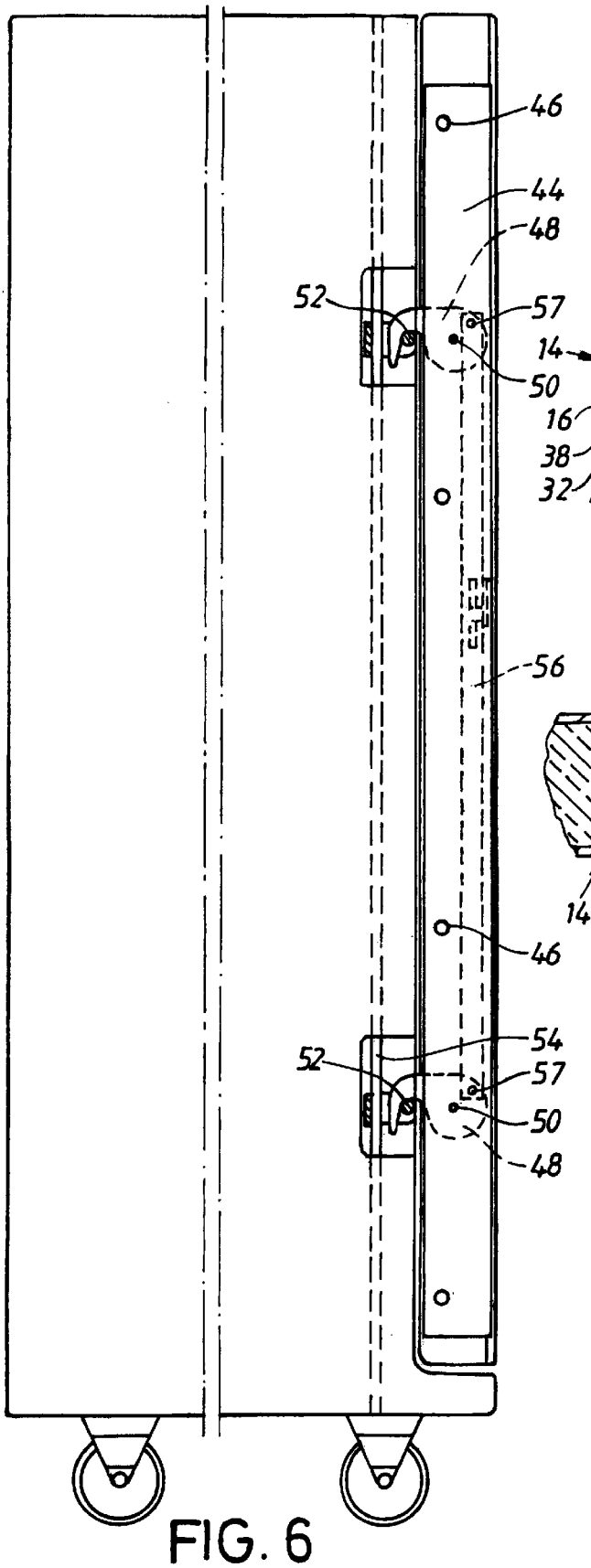
FIG. 6 shows the other side of the container with the door closed.
Figure 3:
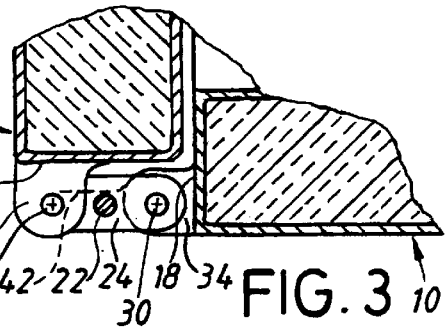
FIG. 3 shows an enlarged part of a section according to the marking III—III in FIG. 1, FIGS. 4 and 5 show, in the same sectional view as FIG. 3, the door opened 90° and 270°, respectively.
Figure 4:
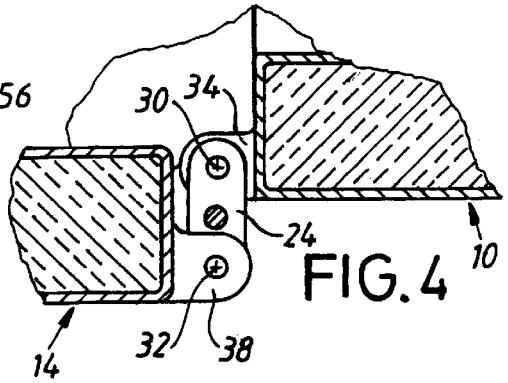
Figure 5:
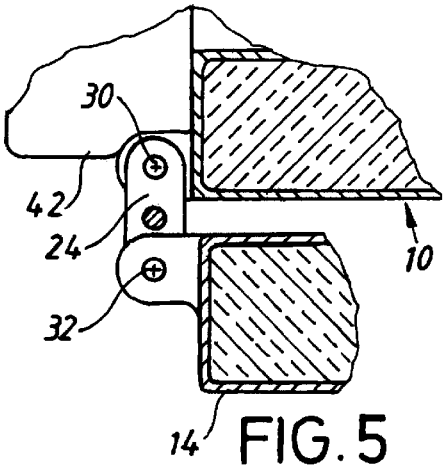
Figure 7:
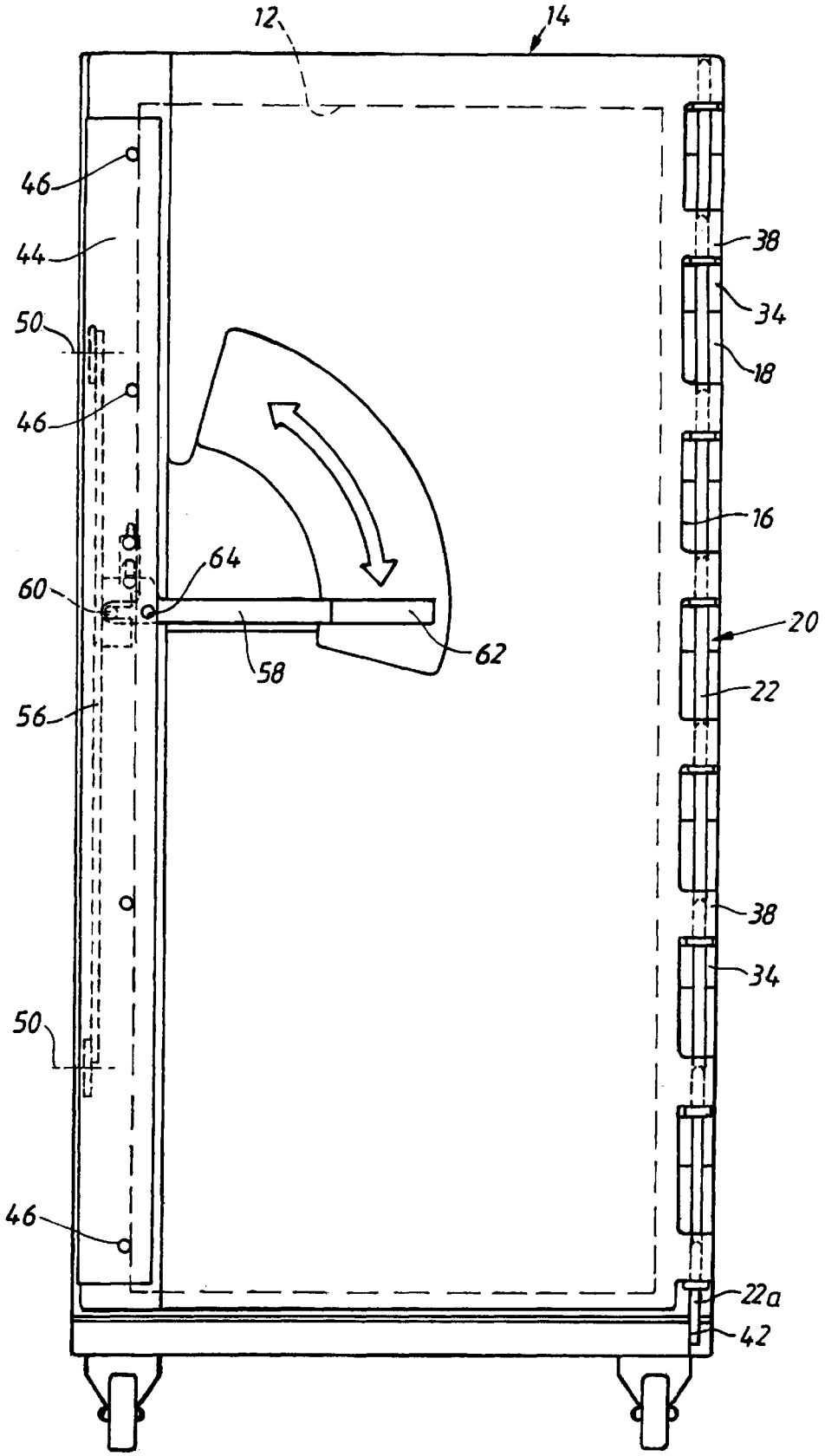
FIG. 7 shows the front of the container with the door closed.

By 10 is designated a box-shaped container with a rectangular access opening 12 closable by a rectangular door 14, which along an edge 16 is turnably journalled around an edge 18 of the container 10 by means of a link means 20. The link means is constituted by a straight rod 22, to which transverse, oblong plates 24 are fastened at regular intervals. To one end of the respective plate 24 is fastened a downwardly directed pin 26 and to the other end an upwardly directed pin 28. The pins 26 are located along a first axis 30 and the pins 28 along a second axis 32, which axes are parallel to each other. The edge 18 of the container 10 is provided with protrusions 34 with holes 36 for journalling of the pins 26 and the edge 16 of the door is provided with protrusions 38 with holes 40 for journalling of the pins 28.

The door 14 is mounted to the container 10 in that way that the link means 20 first is hooked into the holes 36 with the pins 26 so that the plates 24 rest on the protrusions 34, after which the door 14 with its holes 40 is hooked onto the pins 28 so that the protrusions 38 rest on the plates 24. The link means 20 and the protrusions 34 and 38 are sized so that the door can be opened about 270° when mounted. On closing the door 14, the door is brought into correct position relative to the access opening 12 by both ends 22A of the rod 22 being stopped by surfaces 42 of the container.

To the vertical edge of the door, which is opposite to the edge 16, a bar 44 having a L-profile is fastened by screws 46. Two hooks 48 are turnably journalled on the bar 44 around horizontal axes 50. The hooks 48, which cooperate with pins 52 fastened to a rod 54, which in its turn is fastened to the container, are turnably journalled on a vertical bar 56 around horizontal axes 57. A locking stick 58 with an inner end 60 and an outer end with a handle 62 is between its ends turnably journalled on the bar 44 around a horizontal axis 64.

On lifting the handle 62 the end 60 moves downwards and brings by that the bar 56, which is coupled together with the end 60, to move downwards, the hooks 48 being brought to turn out of engagement with the pins 52. The door is then free to be opened. The locking of the door takes place in reverse order by lowering of the handle 62 after the door has been closed.

The container with its protrusions 34 can be made in one piece of plastic and the door 14 with its protrusions 38 can also be made in one piece of plastic. The container 10 can be made heat insulating by its walls and the door having cavities filled with heat insulating material.

What is claimed is:

1. Container (10) with a rectangular access opening (12) closable by a rectangular door (14), each of the container and the door having an axis (30 and 32, respectively), which are in parallel with and located at a distance from each other and are connected to each other by link means (20) journalled around the axes, so that the door (14) can be opened about 270° relative to the container (10), characterized in that the link means (20) are constituted by a rod (22) having at least three downwardly directed pins (26) journalled in the container (10) around one (30) of the axes and at least three upwardly directed pins (28) journalled in the door (14) around the other axis (32), which pins (26, 28) are fastened in pairs to oblong plates (24), one downwardly directed pin (26) being fastened at one end of the respective plate and one upwardly directed pin (28) being fastened at the other end of the plate and the plates (24) being fastened to the rod (22) between the pins at right angles to the rod.

* * * * *